US008895219B2

(12) United States Patent
Ganapathiappan et al.

(10) Patent No.: US 8,895,219 B2
(45) Date of Patent: Nov. 25, 2014

(54) LIQUID ELECTROPHOTOGRAPHIC INKS

(75) Inventors: Sivapackia Ganapathiappan, Los Altos, CA (US); Hou T. Ng, Campbell, CA (US); Albert Teishev, Rishon le-zion (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 109 days.

(21) Appl. No.: 13/459,602

(22) Filed: Apr. 30, 2012

(65) Prior Publication Data

US 2013/0288176 A1 Oct. 31, 2013

(51) Int. Cl.
*G03G 9/00* (2006.01)
*G03G 5/00* (2006.01)

(52) U.S. Cl.
USPC ..... 430/112; 430/114; 430/137.22; 524/441; 524/500; 523/210; 523/206

(58) Field of Classification Search
CPC ..... G03G 9/00; C08K 5/01; C08K 9/10; C08K 13/02; C08K 2003/0812
USPC ..... 430/112; 524/441
See application file for complete search history.

(56) References Cited

U.S. PATENT DOCUMENTS

| | | | | |
|---|---|---|---|---|
| 3,862,849 | A * | 1/1975 | Kasuya | 430/97 |
| 4,544,600 | A * | 10/1985 | Kern | 428/323 |
| 7,105,263 | B2 | 9/2006 | Moudry et al. | |
| 2011/0091798 | A1 | 4/2011 | Victor et al. | |

FOREIGN PATENT DOCUMENTS

| | | | | |
|---|---|---|---|---|
| EP | 0194776 | | 9/1986 | |
| EP | 2017310 | A1 * | 1/2009 | C09C 1/64 |
| WO | WO-2006041658 | | 4/2006 | |
| WO | WO-2011009488 | | 1/2011 | |
| WO | WO-2011046561 | | 4/2011 | |
| WO | WO-2011136997 | | 11/2011 | |

* cited by examiner

*Primary Examiner* — Vu A Nguyen
(74) *Attorney, Agent, or Firm* — Tsu-shin Su

(57) ABSTRACT

An ink is disclosed. The ink includes a carrier fluid; an encapsulated metallic pigment particle further including a metallic pigment particle and a polymer, wherein the polymer covers between 70% and 100%, inclusive, of the surface area of the metallic pigment particle and wherein the morphology of the metallic pigment particle by itself is substantially the same as the morphology of the metallic pigment particle covered by the polymer; and a polymer resin.

16 Claims, 1 Drawing Sheet

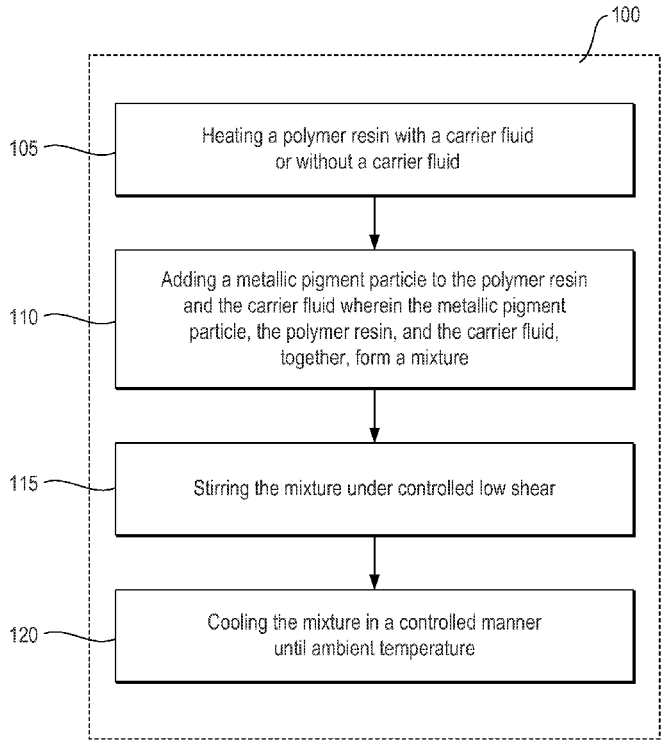

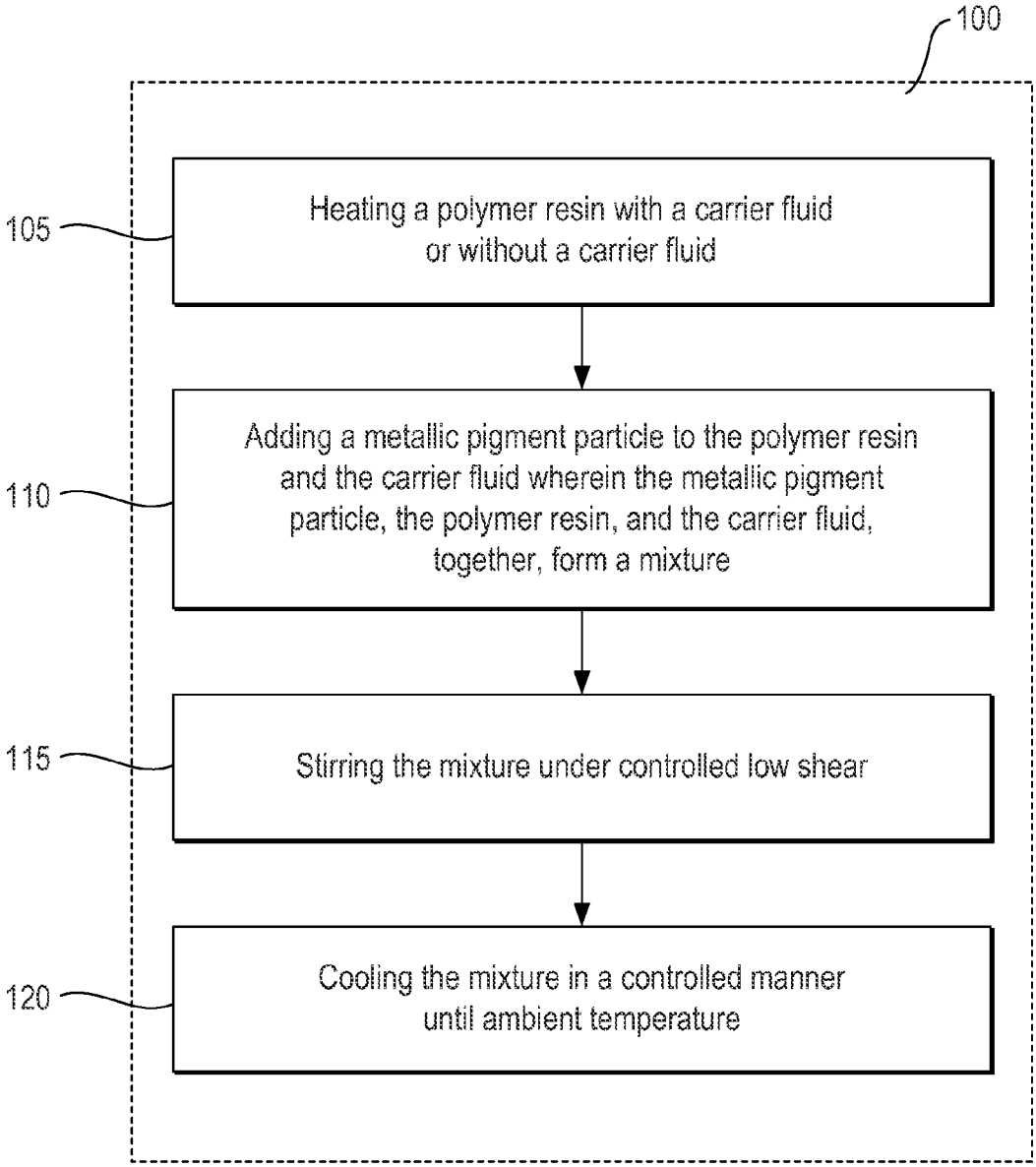
100
105
Heating a polymer resin with a carrier fluid or without a carrier fluid
110
Adding a metallic pigment particle to the polymer resin and the carrier fluid wherein the metallic pigment particle, the polymer resin, and the carrier fluid, together, form a mixture
115
Stirring the mixture under controlled low shear
120
Cooling the mixture in a controlled manner until ambient temperature

LIQUID ELECTROPHOTOGRAPHIC INKS

BACKGROUND

The global print market is in the process of transforming from analog printing to digital printing. As compared to analog printing, digital printing may allow users to create high quality images with greater ability to customize individual prints. It may also allow users to create short runs of prints at a fraction of the cost of a similar run on a traditional analog press. Some known methods of digital printing include, but are not limited to, electrophotographic printing, full-color ink-jet, laser photo printing, and thermal transfer printing methods.

Electrophotographic printing techniques may involve the formation of a latent image on a photoconductor surface mounted on an imaging plate. In some examples, the photoconductor may first be sensitized to light, in one example through charging with a corona discharge, and then, may be exposed to light projected through a positive film of the document to be reproduced. This may result in dissipation of the charge in the exposed areas and the formation of a latent image on the photoconductor. The latent image may subsequently be developed into a full image by the attraction of oppositely charged toner particles to the charge remaining on the unexposed areas. Next, the developed image may be transferred from the photoconductor to the blanket, which in one example is a fabric-reinforced sheet of rubber or polymer wrapped around a cylinder which may receive the toner from the photoconductor before it is transferred to the substrate. From the blanket, the image may be transferred to organic or inorganic substrates, such as paper, plastic or other suitable materials, by heat, pressure, a combination thereof, or any other suitable method, to produce the printed final image.

The latent image may be developed using either a dry toner (a colorant mixed with a powder carrier) or a liquid ink (a suspension of a colorant in a liquid carrier). In some examples, the quality of the final image may be related to the size of the colorant particles. Smaller particles may provide images with a higher resolution because the smaller particle size may allow for transfer of more particles in the same area and the delineation of finer details in the image.

BRIEF DESCRIPTION OF THE DRAWINGS

The detailed description will make reference to the following drawings, in which like reference numerals may correspond to similar, though perhaps not identical, components.

FIG. 1 is a flow chart depicting an example of a process for encapsulating metallic pigments.

DETAILED DESCRIPTION

Reference is now made in detail to specific examples of the disclosed liquid electrophotographic (LEP) inks and specific examples of methods for making such LEP inks. When applicable, alternative examples are also briefly described.

It is noted that, as used in this specification and the appended claims, the singular forms "a," "an," and "the" include plural referents unless the context clearly dictates otherwise.

As used herein, "carrier fluid," "carrier fluid", or "liquid vehicle" refers to the fluid in which the pigmented resin material of the present disclosure can be dispersed to form an ink dispersion. A carrier fluid can be formulated for electrophotographic printing such that the electrophotographic ink has a viscosity and conductivity for such printing, and may include one or more additives, including without limitation, surfactants, organic solvents, charge control agents, viscosity modifiers, sequestering agents, stabilizing agents, and anti-kogation agents.

As used herein, a "print" or "printed media" is the combination of an organic or inorganic substrate and an ink or toner used to display a variety of forms or "images", including, but not limited to, text, graphics, characters, images, or photographs.

As used in this specification and the appended claims, "about" means a ±10% variance caused by, for example, variations in manufacturing processes.

As used in this specification and the appended claims, "substantially" means to a large extent but not completely. For example, two objects that have substantially similar morphology have largely but not completely the same form, shape, or appearance.

As used in this specification and the appended claims, "ambient temperature" means the temperature of the environment. For example, cooling a liquid mixture in a room to ambient temperatures means cooling the liquid to about the temperature of the room.

In formulating and creating LEP inks, a pigment particle or colorant particle is typically added. In some examples, an organic pigment may be used as organic pigments do not have high conductivity. In other examples, such as in specialized printing applications, metallic pigment particles may be used to create prints with metallic effects. However, metallic pigments have high conductivity and if they are used in an LEP ink without anything to counteract such conductivity, the resulting prints may be duller and of poorer quality due to the development of pigment particles in undesired areas or in other words, the formation of images in undesired areas.

In the past, scientists have researched the problem of high conductivity in pigments by finding ways to encapsulate the metallic pigments in polymer resins. However, incomplete encapsulation of the metallic pigments may result in partial exposure of the metallic pigments in the ink which may lead to undesirable background development on the media or as briefly discussed above, the formation of images in undesired areas. To address the problem of incomplete encapsulation, scientists have researched using high shear processes for encapsulating the pigments. However, during high shear processes, the pigment particles may be fragmented and encapsulation may lead to a change in morphology of the encapsulated particle surface from the unencapsulated particle surface. In prints, such changes may lead to poorer scattering of incidental light resulting in prints with duller colors.

A new LEP ink including encapsulated metallic pigments and a process for encapsulating metallic pigments is disclosed, wherein the encapsulated metallic pigments are 70% to 100% encapsulated in a resin matrix such that the overall ink particle conductivity may be reduced which may lead to better quality prints. Additionally, unlike using high shear to produce encapsulation, the process disclosed herein may not result in the fragmentation or aggregation of metallic pigment particles and may result in encapsulated metallic pigment particles with substantially the same morphology as unencapsulated metallic pigment particles. Retention of morphology in the metallic pigment particles, improves the Flop Index of the ink or, in other words, improves the ability of the metallic pigments to reflect light. In general, a printed image with a Flop Index above 8 has been accepted by the community as a printed image with commercially acceptable metallic properties or effects. Without subscribing to any particular theory, the improved Flop Index may be due to the ability of the encapsulated pigment particles to lie flat on the substrate.

Finally, in contrast to past practices, the encapsulated metallic pigment disclosed herein may be manufactured in a process involving a single in-line step which may result in the process having high throughput and manufacturing cost savings due to a decreased number of manufacturing steps.

Examples of the LEP ink disclosed herein include a carrier fluid, a polymer resin, and a polymer encapsulated metallic pigment particle. Furthermore, in some examples and as further discussed below, other additives, such as charge directors, dispersants, or surfactants, may also be included. Finally, in some examples and also as further described below, the LEP ink may further include a colorant particle or a pigment particle that may provide color to the LEP ink.

In some examples, the carrier fluid may act as a dispersing medium for the other components in the LEP ink. In one example, non-polar carrier fluids may be used, wherein such non-polar carrier fluids may have one or more properties such as, but not limited to, low odor, lack of color, selective solvency, oxidation stability, low electrical conductivity, low skin irritation, low surface tension, desirable wetting, spreadability, low viscosity, narrow boiling point range, non-corrosive to metals, low freezing point, high electrical resistivity, high interfacial tension, low latent heat of vaporization, or low photochemical reactivity.

Specifically, examples of non-polar carrier fluids may include one or more substituted or unsubstituted hydrocarbons wherein the hydrocarbon may be linear, cyclic or branched and may be substituted with any functional group. In one example, the hydrocarbon included in the non-polar carrier fluid may be substantially nonaqueous, i.e. containing less than 0.5 weight percent (wt %) water. In another example, the hydrocarbons may be nonaqueous, i.e. containing no water.

Some specific examples of suitable carrier fluids may include, but are not limited to, dielectric liquids, non-oxidative water immiscible liquids, paraffins, isoparaffins, or oils. In some specific examples, suitable carrier fluids may include, but are not limited to, alkanes having from about 6 to about 100 carbon atoms, inclusive, alkanes having from 6 to 14 carbon atoms, inclusive, cycloalkanes having from 6 to 14 carbon atoms, inclusive (e.g., n-hexanes, heptanes, octane, dodecane, cyclohexane, etc.), t-butylbenzene, 2,2,4-trimethylpentane, isoparaffinic hydrocarbons, paraffinic hydrocarbons, aliphatic hydrocarbons, de-aromatized hydrocarbons, halogenated hyrdrocarbons, cyclic hydrocarbons, functionalized hydrocarbons, or combinations thereof. Specific examples of oils may include silicone oil, soy bean oil, vegetable oil, plant extracts, or combinations thereof. Specific examples of paraffins and isoparaffins include those in the ISOPAR® family (available from Exxon Mobil Corporation, Fairfax, Va., USA). In other examples, other hydrocarbons that may be used as a non-polar carrier fluid include those bearing the trade name SOLTROL® (available from Chevron Phillips Chemical Company, The Woodlands, Tex., USA) or SHELLSOL® (available from Shell Chemicals, Eschborn, Del., USA).

In LEP inks, polymer resins may be used to improve a print's quality and durability. In some examples, during formation of the polymer film, pigments or colorants become trapped in the polymer matrix and are thereby protected by the polymer film. Additionally, in some examples, the polymer resin may also provide structural integrity for the ink film after printing, which may promote adhesion to the substrate and protect against rubbing or scratching. In the ink disclosed herein, the polymer resin may be used to encapsulate a metallic pigment particle in order to reduce conductivity of the particle. In one example, the polymer resin may be a thermoplastic polymer. Specific examples of the polymer resin include ethylene acid copolymers; ethylene acrylic acid copolymers; methacrylic acid copolymers; ethylene vinyl acetate copolymers; copolymers of ethylene acid and alkyls, acrylic acid and alkyls, or methacrylic acid and alkyls (with carbon chain lengths between 1 and 20 carbons, inclusive); esters of methacrylic acid or acrylic acid; polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g., copolymer of acrylic or methacrylic acid and at least one alkyl ester of acrylic or methacrylic acid where the alkyl is from 1 to about 20 carbon atoms, such as methyl methacrylate/methacrylic acid/ethylhexylacrylate); ethylene-acrylate terpolymers; ethylene-acrylic esters-maleic anhydride (MAH) or glycidyl methacrylate (GMA) terpolymers; low molecular weight ethylene-acrylic acid ionomers (i.e., those having a molecular weight less than 1000 amu), or combinations thereof. In one example, the polymer resin is selected from the NUCREL® or BYNEL® family of polymers (available from DuPont Company, Wilmington, Del., USA, e.g., NUCREL® 403, NUCREL® 407, NUCREL® 609HS, NUCREL® 908HS, NUCREL® 1202HC, NUCREL® 30707, NUCREL® 1214, NUCREL® 903, NUCREL® 3990, NUCREL® 910, NUCREL® 925, NUCREL® 609, NUCREL® 599, NUCREL® 960, NUCREL® RX 76, NUCREL® 2806, BYNEL® 2002, BYNEL® 2014, or BYNEL® 2020), the ACLYN® family of polymers (available from Honeywell International, Inc., Morristown, N.J., USA, e.g., ACLYN® 201, ACLYN® 246, ACLYN® 285, or ACLYN® 295), or the LOTADER® family of polymers (available from Arkema, Inc., King of Prussia, Pa., USA e.g., LOTADER® 2210, LOTADER® 3430, or LOTADER® 8200). In some instances, the polymer resin may have one or more functional groups such as, but not limited to, carboxylic acid, ester, amide, amine, urea, anhydride, aromatic, or halogen based groups. Additionally, in some examples, any of the listed polymer resins may be used alone or in combination with any of the other above listed polymer resins.

In some examples, LEP inks may further include other additives including, but not limited to, anti-curl agents, binders, charge directors, corrosion inhibitors, dispersants, light stabilizers, optical brighteners, polymers, resins, rheology modifiers, UV curable materials, surface-active agents or combinations thereof. Such additives may serve to enhance print performance, improve the reliability of the printhead, improve the quality of images printed on media substrate or otherwise improve the quality of the ink or use of the ink. In one example, wherein the LEP ink includes other additives, the resin makes up between 1% and 8% inclusive of the ink, the encapsulated metallic pigment particles makes up between 0.1% and 10% inclusive of the ink, the other additives make up between 0.1% and 20% inclusive of the ink, and the carrier fluid makes up the balance of the ink.

In one example, the LEP ink disclosed herein may include a charge director. As used herein, the term "charge director" refers to a material that, when used, facilitates charging of the metallic pigment particles. In one example, the charge director may be basic and may react with the acid-modified metallic pigment particle to negatively charge the particle. In other words, the charging of the particle may be accomplished via an acid-base reaction (or interaction) between the charge director and the acid-modified particle surface. It is to be understood that the charge director may also be used in the LEP ink to prevent undesirable aggregation of the metallic pigment particles in the carrier fluid. In other examples, the charge director may be acidic and may react (or interact) with the base-modified metallic pigment particle to positively charge the particle. Again, the charging of the particle may be accomplished via an acid-base reaction (or interaction) between the charge director and the base-modified particle surface.

As discussed previously, in some examples, the LEP ink may further include a metallic pigment particle that becomes encapsulated in a polymer resin as described below. In some examples, the metallic pigment particle includes any metal that can form a reflective surface. Some specific examples of such a metal include, but are not limited to, aluminum, silver, nickel, copper, tin, indium, and zinc. In some examples, such metallic pigment particles may be proprietary commercial components. In such examples wherein a proprietary metallic pigment particle may be used, the metallic pigment particle may further include additional additives depending on how the metallic pigment particle is manufactured such as oils or organic compounds.

Finally, in some examples, the LEP ink may further include a pigment particle. In one example, the pigment particle or colorant may be a colored pigment or colored polymeric particle in any possible color, such as RGB or CYMK, with a size ranging from 10 nm to 10 μm. In some examples, smaller particles, with a particle size from 1 to 10 nm, such as quantum dots, may be employed. In other examples, the particle size may range to a few micrometers. Additionally, organic or inorganic pigments may be used.

Organic and inorganic pigment particles may be selected from black pigment particles, yellow pigment particles, magenta pigment particles, red pigment particles, violet pigment particles, cyan pigment particles, blue pigment particles, green pigment particles, orange pigment particles, brown pigment particles or white pigment particles. In some instances, the organic or inorganic pigment particles may include spot-color pigment particles, which are formed from a combination of a predefined ratio of two or more primary color pigment particles.

A non-limiting example of a suitable inorganic black pigment includes carbon black. Examples of carbon black pigments include those manufactured by Mitsubishi Chemical Corporation, Japan (such as, e.g., carbon black No. 2300, No. 900, MCF88, No. 33, No. 40, No. 45, No. 52, MA7, MA8, MA100 or No. 0B); various carbon black pigments of the RAVEN® series manufactured by Columbian Chemicals Company, Marietta, Ga., (such as, e.g., RAVEN® 5750, RAVEN® 5250, RAVEN® 5000, RAVEN® 3500, RAVEN® 1255 or RAVEN® 700); various carbon black pigments of the REGAL® series, the MOGUL® series or the MONARCH® series manufactured by Cabot Corporation, Boston, Mass., (such as, e.g., REGAL® 400R, REGAL® 330R, REGAL® 660R, MOGUL® L, MONARCH® 700, MONARCH® 800, MONARCH® 880, MONARCH® 900, MONARCH® 1000, MONARCH® 1100, MONARCH® 1300 or MONARCH® 1400); or various black pigments manufactured by Evonik Degussa Corporation, Parsippany, N.J., (such as, e.g., Color Black FW1, Color Black FW2, Color Black FW2V, Color Black FW18, Color Black FW200, Color Black S150, Color Black S160, Color Black S170, PRINTEX® 35, PRINTEX® U, PRINTEX® V, PRINTEX® 140U, Special Black 5, Special Black 6A or Special Black 4). A non-limiting example of an organic black pigment includes aniline black, such as C.I. Pigment Black 1.

Other examples of inorganic pigments include metal oxides and ceramics, such as the oxides of iron, zinc, cobalt, manganese or nickel. Non-limiting examples of suitable inorganic pigments include those from the Shepherd Color Company (Cincinnati, Ohio) such as Black 10C909A, Black 10P922, Black 1G, Black 20F944, Black 30C933, Black 30C940, Black 30C965, Black 376A, Black 40P925, Black 411A, Black 430, Black 444, Blue 10F545, Blue 10G511, Blue 10G551, Blue 10K525, Blue 10K579, Blue 211, Blue 212, Blue 214, Blue 30C527, Blue 30C588, Blue 30C591, Blue 385, Blue 40P585, Blue 424, Brown 10C873, Brown 10P835, Brown 10P850, Brown 10P857, Brown 157, Brown 20C819, Green 10K637, Green 187 B, Green 223, Green 260, Green 30C612, Green 30C654, Green 30C678, Green 40P601, Green 410, Orange 10P320, StarLight FL 37, StarLight FL105, StarLight FL500, Violet 11, Violet 11C, Violet 92, Yellow 10C112, Yellow 10C242, Yellow 10C272, Yellow 10P110, Yellow 10P225, Yellow 10P270, Yellow 196, Yellow 20P296, Yellow 30C119, Yellow 30C236, Yellow 40P140 or Yellow 40P280.

The following is a non-limiting list of organic pigments that may be used in accordance with the teachings herein. Non-limiting examples of suitable yellow pigments include C.I. Pigment Yellow 1, C.I. Pigment Yellow 2, C.I. Pigment Yellow 3, C.I. Pigment Yellow 4, C.I. Pigment Yellow 5, C.I. Pigment Yellow 6, C.I. Pigment Yellow 7, C.I. Pigment Yellow 10, C.I. Pigment Yellow 11, C.I. Pigment Yellow 12, C.I. Pigment Yellow 13, C.I. Pigment Yellow 14, C.I. Pigment Yellow 16, C.I. Pigment Yellow 17, C.I. Pigment Yellow 24, C.I. Pigment Yellow 34, C.I. Pigment Yellow 35, C.I. Pigment Yellow 37, C.I. Pigment Yellow 53, C.I. Pigment Yellow 55, C.I. Pigment Yellow 65, C.I. Pigment Yellow 73, C.I. Pigment Yellow 74, C.I. Pigment Yellow 75, C.I. Pigment Yellow 81, C.I. Pigment Yellow 83, C.I. Pigment Yellow 93, C.I. Pigment Yellow 94, C.I. Pigment Yellow 95, C.I. Pigment Yellow 97, C.I. Pigment Yellow 98, C.I. Pigment Yellow 99, C.I. Pigment Yellow 108, C.I. Pigment Yellow 109, C.I. Pigment Yellow 110, C.I. Pigment Yellow 113, C.I. Pigment Yellow 114, C.I. Pigment Yellow 117, C.I. Pigment Yellow 120, C.I. Pigment Yellow 124, C.I. Pigment Yellow 128, C.I. Pigment Yellow 129, C.I. Pigment Yellow 133, C.I. Pigment Yellow 138, C.I. Pigment Yellow 139, C.I. Pigment Yellow 147, C.I. Pigment Yellow 151, C.I. Pigment Yellow 153, C.I. Pigment Yellow 154, Pigment Yellow 155, C.I. Pigment Yellow 167, C.I. Pigment Yellow 172 or C.I. Pigment Yellow 180.

Non-limiting examples of suitable magenta or red or violet organic pigments include C.I. Pigment Red 1, C.I. Pigment Red 2, C.I. Pigment Red 3, C.I. Pigment Red 4, C.I. Pigment Red 5, C.I. Pigment Red 6, C.I. Pigment Red 7, C.I. Pigment Red 8, C.I. Pigment Red 9, C.I. Pigment Red 10, C.I. Pigment Red 11, C.I. Pigment Red 12, C.I. Pigment Red 14, C.I. Pigment Red 15, C.I. Pigment Red 16, C.I. Pigment Red 17, C.I. Pigment Red 18, C.I. Pigment Red 19, C.I. Pigment Red 21, C.I. Pigment Red 22, C.I. Pigment Red 23, C.I. Pigment Red 30, C.I. Pigment Red 31, C.I. Pigment Red 32, C.I. Pigment Red 37, C.I. Pigment Red 38, C.I. Pigment Red 40, C.I. Pigment Red 41, C.I. Pigment Red 42, C.I. Pigment Red 48(Ca), C.I. Pigment Red 48(Mn), C.I. Pigment Red 57(Ca), C.I. Pigment Red 57:1, C.I. Pigment Red 88, C.I. Pigment Red 112, C.I. Pigment Red 114, C.I. Pigment Red 122, C.I. Pigment Red 123, C.I. Pigment Red 144, C.I. Pigment Red 146, C.I. Pigment Red 149, C.I. Pigment Red 150, C.I. Pigment Red 166, C.I. Pigment Red 168, C.I. Pigment Red 170, C.I. Pigment Red 171, C.I. Pigment Red 175, C.I. Pigment Red 176, C.I. Pigment Red 177, C.I. Pigment Red 178, C.I. Pigment Red 179, C.I. Pigment Red 184, C.I. Pigment Red 185, C.I. Pigment Red 187, C.I. Pigment Red 202, C.I. Pigment Red 209, C.I. Pigment Red 219, C.I. Pigment Red 224, C.I. Pigment Red 245, C.I. Pigment Violet 19, C.I. Pigment Violet 23, C.I. Pigment Violet 32, C.I. Pigment Violet 33, C.I. Pigment Violet 36, C.I. Pigment Violet 38, C.I. Pigment Violet 43 or C.I. Pigment Violet 50.

Non-limiting examples of blue or cyan organic pigments include C.I. Pigment Blue 1, C.I. Pigment Blue 2, C.I. Pigment Blue 3, C.I. Pigment Blue 15, C.I. Pigment Blue 15:3, C.I. Pigment Blue 15:34, C.I. Pigment Blue 15:4, C.I. Pigment Blue 16, C.I. Pigment Blue 18, C.I. Pigment Blue 22, C.I. Pigment Blue 25, C.I. Pigment Blue 60, C.I. Pigment Blue 65, C.I. Pigment Blue 66, C.I. Vat Blue 4 or C.I. Vat Blue 60.

Non-limiting examples of green organic pigments include C.I. Pigment Green 1, C.I. Pigment Green 2, C.I. Pigment Green 4, C.I. Pigment Green 7, C.I. Pigment Green 8, C.I. Pigment Green 10, C.I. Pigment Green 36 or C.I. Pigment Green 45.

Non-limiting examples of brown organic pigments include C.I. Pigment Brown 1, C.I. Pigment Brown 5, C.I. Pigment Brown 22, C.I. Pigment Brown 23, C.I. Pigment Brown 25, and C.I. Pigment Brown, C.I. Pigment Brown 41 or C.I. Pigment Brown 42.

Non-limiting examples of orange organic pigments include C.I. Pigment Orange 1, C.I. Pigment Orange 2, C.I. Pigment Orange 5, C.I. Pigment Orange 7, C.I. Pigment Orange 13, C.I. Pigment Orange 15, C.I. Pigment Orange 16, C.I. Pigment Orange 17, C.I. Pigment Orange 19, C.I. Pigment Orange 24, C.I. Pigment Orange 34, C.I. Pigment Orange 36, C.I. Pigment Orange 38, C.I. Pigment Orange 40, C.I. Pigment Orange 43 or C.I. Pigment Orange 66.

Turning now to processes for manufacturing such inks including encapsulated metallic pigment particles, FIG. 1 is a flow chart depicting an example of a process for encapsulating metallic pigment particles 100. As discussed previously, the ink disclosed herein may be made using a novel single step in-line process 100 with multiple sub-steps. In a general example, a resin in the carrier fluid with or without dispersant is heated 105 using any suitable processes until a homogenous solution is formed. After a homogenous mixture is formed, the heated mixture may be combined and mixed with the metallic pigment particles 110 under controlled low shear 115. As used herein, "controlled" means at a constant rate. Additionally, as used herein, "low shear" means at a rate of between 30 and 1000 rpm, inclusive. In one example, the mixture is mixed using an attritor. In other examples, any other suitable processes may be used. In some examples, the addition of beads to the mixture may lower the shear of the mixture. The beads may be of any suitable materials, including, but not limited to, glass, stainless steel, or zirconia-based or yttria-based ceramics. In some examples, beads of between 0.5 and 10 mm, inclusive, in diameter may be used. In one more specific example, a mixture may be stirred at a rate of between 60 and 200 rpm and include beads of between 2 and 5 mm in diameter.

In some examples, the size of the metallic pigment particles can be controlled by grinding the pigment particles or with dispersants. In examples wherein grinding is used to control the size of the metallic pigment particles, a microfluidizer may be used to grind the particles; in other examples, any other suitable tool may be used to grind the particles. In examples wherein dispersants are used to control the size of metallic pigment particles, suitable dispersants may include, but are not limited to, polyethylene succinimide derivatives, such as compounds made available from Lubrizol (Wickliffe, Ohio).

The mixture may be cooled to ambient temperature in a controlled manner 120, such as by active cooling with coolants or any other suitable method. As used herein, a "controlled manner" of cooling is cooling conducted at a rate of between 1 and 10° C. inclusive per minute. In one more specific example, the controlled cooling is conducted at a rate of between 2 to 7° C. per minute and in another more specific example, the controlled cooling is conducted at a rate of between 3 to 5° C. per minute. As the mixture is cooled, the resins phase may separate from the carrier fluid and wrap around the metallic pigment particles present in the fluid. Without subscribing to any particular theory, when the temperature of the mixture causes the mixture to reach a certain solubility limit, the resin may thicken and any further reduction in temperature of the mixture may result in phase separation of the resins. The metallic pigment particles present in the mixture may serve as nucleation sites for the resins, which may result in the resins wrapping around the metallic pigment particles. However, if the temperature of the mixture is cooled too rapidly, precipitation of the resins instead of phase separation may occur, which may lead to aggregation of the metallic pigment particles.

Finally, as discussed above, in some examples, the mixture may further include other additives, such as surfactants, dispersants, or charge directors. Such additives may be added prior to using the ink in printing processes.

Turning now to a method of printing using the ink described herein, in one example, the LEP ink including an encapsulated metallic pigment particle may be loaded into a LEP printer and then, a layer of the ink may be printed onto a substrate. In one example, no other layers of ink have been printed on the substrate. In another example, the layer of ink may be printed on a substrate already including one or more layers of pigmented ink. In some examples, such pigmented inks used in creating such pigmented ink layers may include one or more of the same components as the LEP ink including an encapsulated metallic pigment particle, as described above. For example, such pigmented inks may include one or more components selected from the group consisting of a carrier fluid, a polymer resin, and other additives. Additionally, such pigmented inks may further include a colorant or a pigment particle with the same properties as the pigment particles that may be included in the inks including encapsulated metallic pigment particles.

In one example wherein one or more layers of one or more pigmented inks are already present on the substrate, a layer of the ink including an encapsulated metallic pigment as described herein may be printed on top of such pigmented ink or inks in order to give the printed image a metallic look. In another example, the ink including an encapsulated metallic pigment may be printed on a substrate with no layers of ink already present.

In yet another example, one or more additional layers of one or more pigmented inks may be printed on top of an ink including an encapsulated metallic pigment particle layer which may or may not be on top of one or more other pigmented ink layers. In some examples, subsequent layers including pigmented inks may obscure the metallic effect created by the printed layer or layers of inks including an encapsulated metallic pigment particle. In such examples, the subsequently printed layers including pigmented inks may be used to limit the metallic effect to selected areas of the image.

In some examples, the ink including an encapsulated metallic pigment may be printed on a variety of different organic and inorganic substrates, including but not limited to vinyl media, cellulose-based paper media, various cloth materials, polymeric materials (non-limitative examples of which may include polyester white film or polyester transparent film), photopaper (non-limiting examples of which may include polyethylene or polypropylene extruded on one or both sides of paper), metals, or mixtures or composites thereof.

EXAMPLES

Example 1

Encapsulation of Aluminum Pigment Particles with 50% Aluminum Content with Soft Resin In one example, Isopar® (92 grams (g)) (available from Exxon Mobil, Irving, Tex.) and a Lubrizol® dispersant (6.0 g of 50% solid content) were stirred together at 200 rpm and heated to 125° C. in a 750 milliliter (mL) sized ceramic chamber of a S-0 attritor (available from Union Process Company, Akron, Ohio) with 200 mL of 2 millimeter (mm) sized zirconia beads. During the process, when the temperature reached 110° C., a proprietary polyethylene resin (10 g) was added. 5 minutes later, aluminum paste (10 g), serving as the metallic pigment, was also added. In order to form a more homogenous mixture, the mixture was stirred for 30 minutes. Next, the mixture was cooled in a controlled manner to 20° C. When the temperature of the chamber reached 47° C. from 110° C., Isopar® (55 g) was added to the mixture. Then, when the temperature reached 20° C., additional Isopar® (35 g) was added and the stirring speed was reduced to 70 rpm. Finally, the solution was allowed to stir at 20° C. for 16 hours. The Flop Index of the resulting encapsulated metallic pigment particles was measured using a densitometer and was found to be 16. Accordingly, when used in inks, the encapsulated metallic pigments made from the process disclosed herein may lead to brighter, higher quality prints.

Example 2

Encapsulation of Aluminum Pigment Particles with 40% Aluminum Content

In one example, an S-0 attritor was heated to 120° C. and proprietary polyethylene resins totaling 12 g were added. Next, after the resins melted, aluminum paste (8 g), serving as the metallic pigment particle, was added and the mixture was mixed until it formed a homogenous solution. Then, 2 mm zirconia beads (200 ml) were added to the mixture and the mixture was stirred at 70 rpm. After 4 minutes, Isopar® (65 g) was added to the solution and the total mixture was stirred for another 15 minutes. Next, the rate of stirring was increased to 200 rpm for 1 minute. Then, the mixture was cooled in a controlled manner to 20° C. During the cooling process, when the temperature fell to 75° C., a Lubrizol® dispersant solution (6.0 g of 50% solid content) in Isopar® (74 g) was added to the mixture. Once the reaction mixture had cooled to ambient temperature, stirring of the mixture was reduced to a speed of 70 rpm and the mixture was stirred for 17 hours. The resulting solution was collected from the zirconia beads by adding additional Isopar®. The Flop Index of the resulting encapsulated particles was measured using a densitometer and was found to be 8.7. The non-imaged area (the background area) had a Flop Index of 0.47 after two separations, or after two print runs for increasing ink density, indicating that there was little unwanted transfer of the ink to the non-imaged area. Accordingly, when used in inks, the encapsulated metallic pigment particles made from the process disclosed herein may lead to brighter, higher quality prints. Finally, it should be noted that the decrease in Flop Index between the printed image of Example 2 and Example 1 may be attributed to the decrease in metallic pigment (i.e. aluminum) added to the ink in Example 2.

Example 3

Encapsulation of Aluminum Pigment Particles with 40% Aluminum Content with Increased Amounts of Proprietary Polyethylene Resins In one example, a S-0 attritor was heated to 120° C. and proprietary polyethylene resins totaling 12 g were added. After the polymer resins melted, aluminum paste (8 g), serving as the metallic pigment particle, was added to the mixture. The mixture was mixed until a homogenous solution was formed. Afterwards, 200 mL of 2 mm zirconia beads were added to the mixture and the mixture was stirred at 70 rpm. After 4 minutes, Isopar® (65 g) was added to the mixture and the mixture was stirred for an additional 15 minutes. Next, the stirring was increased to 200 rpm for 1 minute. Then, a solution of a Lubrizol® dispersant (6 g of 50% solid) in Isopar® (74 g) was added. After 15 minutes of stirring at 200 rpm, the mixture was cooled in a controlled way to 20° C. at a cooling rate of 3° C. per minute. Once the reaction mixture reached ambient temperature, the speed of stirring of the mixture was reduced to 70 rpm and the mixture was stirred for 17 hours. Finally, the solution was collected from the zirconia beads by the addition of more Isopar to the mixture in order to obtain the encapsulated metallic pigment particles. The Flop Index of the resulting encapsulated metallic pigment particles was measured using a densitometer and was found to be 9.8. The non-imaged area was found to have a Flop Index of 0.38 after two separations, again indicating that there was little unwanted transfer of the ink to the non-imaged area. Accordingly, when used in inks, the encapsulated metallic pigments made from the process disclosed herein lead to brighter, higher quality prints.

Example 4

Encapsulation of Aluminum Pigment Particles with Lubrizol® Dispersant

In one set of examples, inks were created using a 0%, 30% and 60% proportion of Lubrizol® dispersant to metallic pigment particles and polymer resins. First, a resin solution was created by adding proprietary polyethylene resins totaling 64 g in Isopar® (656 g) at a temperature above 120° C. In the example wherein the Lubrizol® dispersant was included in a 30% proportion, 48 g of a 50% solid Lubrizol® dispersant was added and the amount of Isopar® was correspondingly reduced from 208 g to 160 g. In the example wherein the Lubrizol® dispersant was included in a 60% proportion, the amount of Isopar® was similarly adjusted. The metallic pigment particle dispersion was created by milling aluminum paste (52 g), used in this example as the metallic pigment particle, with Isopar® (208 g) in a S-0 attritor with zirconia beads 5 mm in diameter (475 g) for 45 minutes at 20° C. Next, the resulting pigment dispersion (80 g) was added to the resin solution and mixed. After a homogeneous solution was obtained, the mixture was cooled in a controlled manner to 110° C. and maintained at that temperature for 30 minutes. Then, the mixture was cooled in a controlled manner to 70° C. and maintained for 1 hour. Finally, a magnetic spin bar spinning at 250 rpm was placed in the mixture and the mixture was allowed to cool to ambient temperature in a controlled manner. In some examples, the dispersant may further be removed by decanting the final solution and washing it with Isopar®. In removing the dispersant, extraneous polymer resin particles may be removed as well.

Observation of the resulting encapsulated metallic pigment particles under a scanning electron microscope (SEM) showed that an increase in dispersant causes a decrease in the encapsulated metallic pigment particle size. For example, when 60% dispersant was used, the encapsulated metallic pigment particles were between 2 to 18 microns in size, whereas when no dispersant was used, the encapsulated pigment particles could be up to 64 microns in size. In other words, there is a balance between the percent of dispersant used with respect to resin and metallic pigment content. For example, as the dispersant is increased, the particle size decreases and after a certain point, further increase in the dispersant causes the formation of resin particles without encapsulation of the metallic pigment particles.

Example 5

LEP Inks with Aluminum Pigment Particles Including 20% Aluminum Content

Isopar® (100 g) and a Lubrizol® dispersant (6.3 g of 50% solid content) were mixed, stirred at 250 rpm, and heated to 125° C. in a 750 milliliter (mL) sized ceramic chamber of a S-0 attritor with 200 mL of 2 mm sized zirconia beads in order to apply shear uniformly. When the temperature reached 110° C. during the heating process, proprietary polyethylene resins totaling 16 g and aluminum paste (4 g), serving as the metallic pigment particle, were added. The mixture was stirred for 15 minutes in order to form a more homogeneous mixture. Then, the mixture was cooled in a controlled manner to 110° C. and maintained at 110° C. for 15 minutes. Next, the mixture was cooled to 70° C. in a controlled manner and maintained for 1 hour. Finally, the mixture was cooled in a controlled manner to ambient temperature. Observation of the resulting encapsulated metallic pigment particles under a scanning electron microscope (SEM) showed that such pigment particles were between 1 and 20 microns in size.

The encapsulated metallic pigment was further developed into ink in a Q/m cell (where Q is charge and m is mass), used for simulating actual ink prints and studying behaviors of various inks, such that the amount of charge director was equal to 50 mg per gram of solid material. It was determined that the ink was completely developed with no residual ink left on the other side of the electrode of the Q/m cell. In other words, the charged pigment in the LEP ink was completely transferred from the ink to the photoconductor, resulting in a better print with a higher density of pigment particles. The Flop Index of the developed ink was measured to be 11, indicating a commercially acceptable metallic print.

What is claimed is:

1. An ink including:

a carrier fluid;

an encapsulated metallic pigment particle including a metallic pigment particle, wherein the metallic pigment particle is acid-modified, and a polymer, wherein the polymer covers between 70% and 100%, inclusive, of the surface area of the metallic pigment particle and wherein the morphology of the metallic pigment particle by itself is substantially the same as the morphology of the metallic pigment particle covered by the polymer;

a charge director, wherein the charge director is basic, and wherein the charge director negatively charges the metallic pigment particle; and a polymer resin.

2. The ink of claim 1, wherein the carrier fluid is selected from the group consisting of substituted hydrocarbons and non-substituted hydrocarbons.

3. The ink of claim 1, wherein the polymer resin and the polymer each independently include a thermoplastic polymer, and wherein the polymer resin and the polymer include the same thermoplastic polymer or a different thermoplastic polymer.

4. The ink of claim 1, wherein the metallic pigment particle includes any metal that has a reflective surface.

5. The ink of claim 4, wherein the metallic pigment particle includes a metal selected from the group consisting of aluminum, silver, nickel, copper, tin, indium, and zinc.

6. The ink of claim 1, wherein the metallic pigment particle includes aluminum.

7. The ink of claim 1 further including other additives selected from the group consisting of anti-curl agents, binders, charge directors, corrosion inhibitors, dispersants, light stabilizers, optical brighteners, pigment particles, polymers, resins, rheology modifiers, UV curable materials, surface-active agents, and combinations thereof.

8. The ink of claim 7 including other additives, wherein the other additives include a pigment particle, and wherein the pigment particle is selected from the group consisting of black pigment particles, yellow pigment particles, magenta pigment particles, red pigment particles, violet pigment particles, cyan pigment particles, blue pigment particles, green pigment particles, orange pigment particles, brown pigment particles, white pigment particles, and combinations thereof.

9. An ink including:

a carrier fluid;

an encapsulated metallic pigment particle including a metallic pigment particle, wherein the metallic pigment particle is base-modified, and a polymer, wherein the polymer covers between 70% and 100%, inclusive, of the surface area of the metallic pigment particle and wherein the morphology of the metallic pigment particle by itself is substantially the same as the morphology of the metallic pigment particle covered by the polymer;

a charge director, wherein the charge director is acidic, and wherein the charge director positively charges the metallic pigment particle; and a polymer resin.

10. The ink of claim 9, wherein the carrier fluid is selected from the group consisting of substituted hydrocarbons and non-substituted hydrocarbons.

11. The ink of claim 9, wherein the polymer resin and the polymer each independently include a thermoplastic polymer, and wherein the polymer resin and the polymer include the same thermoplastic polymer or a different thermoplastic polymer.

12. The ink of claim 9, wherein the metallic pigment particle includes any metal that has a reflective surface.

13. The ink of claim 12, wherein the metallic pigment particle includes a metal selected from the group consisting of aluminum, silver, nickel, copper, tin, indium, and zinc.

14. The ink of claim 9, wherein the metallic pigment particle includes aluminum.

15. The ink of claim 9 further including other additives selected from the group consisting of anti-curl agents, binders, charge directors, corrosion inhibitors, dispersants, light stabilizers, optical brighteners, pigment particles, polymers, resins, rheology modifiers, UV curable materials, surface-active agents, and combinations thereof.

16. The ink of claim 15 including other additives, wherein the other additives include a pigment particle, and wherein the pigment particle is selected from the group consisting of black pigment particles, yellow pigment particles, magenta pigment particles, red pigment particles, violet pigment particles, cyan pigment particles, blue pigment particles, green pigment particles, orange pigment particles, brown pigment particles, white pigment particles, and combinations thereof.

* * * * *